US010906160B1

(12) United States Patent
Dickison

(10) Patent No.: US 10,906,160 B1
(45) Date of Patent: Feb. 2, 2021

(54) WINGNUT ADJUSTMENT TOOL

(71) Applicant: Glen Ronald Dickison, Calgary (CA)

(72) Inventor: Glen Ronald Dickison, Calgary (CA)

( * ) Notice: Subject to any disclaimer, the term of this patent is extended or adjusted under 35 U.S.C. 154(b) by 202 days.

(21) Appl. No.: 16/109,978

(22) Filed: Aug. 23, 2018

(51) Int. Cl.

| | |
|---|---|
| ***B25B 13/50*** | (2006.01) |
| ***B25B 23/00*** | (2006.01) |
| ***G10D 13/02*** | (2020.01) |
| ***G10D 13/16*** | (2020.01) |

(52) U.S. Cl.
CPC ..... *B25B 13/5091* (2013.01); *B25B 23/0007* (2013.01); *G10D 13/02* (2013.01); *G10D 13/16* (2020.02)

(58) Field of Classification Search
CPC ..... B25B 13/5091; B25B 23/0007
USPC ..... 81/119, 124.2, 177.6, 177.7
See application file for complete search history.

(56) References Cited

U.S. PATENT DOCUMENTS 549,871 A * 11/1895 Fowler ..... B25B 13/24 81/154
1,330,098 A * 2/1920 Smith ..... F16B 23/0007 411/405
2,097,361 A * 10/1937 Bagley ..... B25B 13/04 81/177.6
3,086,414 A * 4/1963 Guy ..... F16B 23/0061 81/176.1
D346,100 S 4/1994 Behrenfeld
5,385,071 A * 1/1995 Her ..... B25B 13/00 81/173
5,896,785 A * 4/1999 Shaw ..... B25B 27/0042 81/121.1
6,843,154 B2 1/2005 Webster et al.
7,034,216 B2 4/2006 DiPietro
7,351,900 B2 4/2008 May
2005/0056137 A1 3/2005 DiPietro
2007/0163400 A1 7/2007 Parise

* cited by examiner

*Primary Examiner* — Hadi Shakeri
(74) *Attorney, Agent, or Firm* — Harpman & Harpman

(57) ABSTRACT

A self-contained folding wingnut tool for a variety of wingnut applications including percussion instruments. The tool has a hinged clamshell housing with multi-spaced pairs of upstanding wingnut engagement elements aligned to engage and adjustably turn wingnuts of various dimensions therebetween. Each pair of upstanding wingnut engagements form opposing space contoured frictional engagement surfaces for the registration with respective portions of a wingnut, positioned therebetween. The opposing spaced wingnut engagement pairs extend from wingnut engagement portion of the hinged housing inwardly from its free end, so when opened and extended an oppositely disposed portion handle is formed by the opposite housing portion for leverage and enclosure when closed.

8 Claims, 6 Drawing Sheets

WINGNUT ADJUSTMENT TOOL

BACKGROUND OF THE INVENTION

1. Technical Field

This invention relates to socket-type engagement tools for tightening wingnuts and associated configured fasteners used for a variety of applications, including percussion instruments, specifically in tightening and loosening their retaining brackets.

2. Description of Prior Art

Prior art devices of this type have been developed to provide tools for the rotational adjustment (tightening and loosening) of wingnuts that are used to secure different threaded attachments including percussion instruments by applying equal rotational pressure to the annular drum head engagement on the drum shell. See for example U.S. Pat. Nos. 6,843,154, 7,034,216, U.S. Pat. No. 7,351,900, D 346100, and U.S. Publications 2005/0056137 A1 and 2007/0163400.

U.S. Pat. Nos. 7,034,216 and 7,351,900 are both directed to T-shaped key configurations used to engage and tighten wingnuts and the like, one of which has a deployable pair of oppositely disposed handles.

U.S. Pat. No. 6,843,154 discloses a drum tool plug combined with a faucet wrench for dual use and purpose.

U.S. Publication 2005/0056137 A1 claims a combination cymbal fastener and drum tuning key with an angular offset bar having multiple extending shaped engagement surfaces.

U.S. Publication 2007/0163400 is directed to a tuning tool having cylindrical body with a multi-slotted engagement end.

Finally, in U.S. Design Pat. D 346,100 discloses an ornamental tuning key having a U-shaped dual engagement portion end on a tab with an oppositely disposed socket.

SUMMARY OF THE INVENTION

A wingnut drum tuning adjustment tool having a contoured hinged housing defining a handle portion and a wingnut engagement portion. Multiple upstanding space contoured effacing engagement surface pairs extend in longitudinally aligned relation from within the wingnut engagement portion. The pairs of engagement surfaces provide for the opposing engagement of a wingnut therebetween allowing for leverage assisted rotational adjustment as required. The tool of the invention folds in half when not in use for transport and storage by the utilization of a center integral hinge.

DETAILED DESCRIPTION OF THE INVENTION

Figure 1:
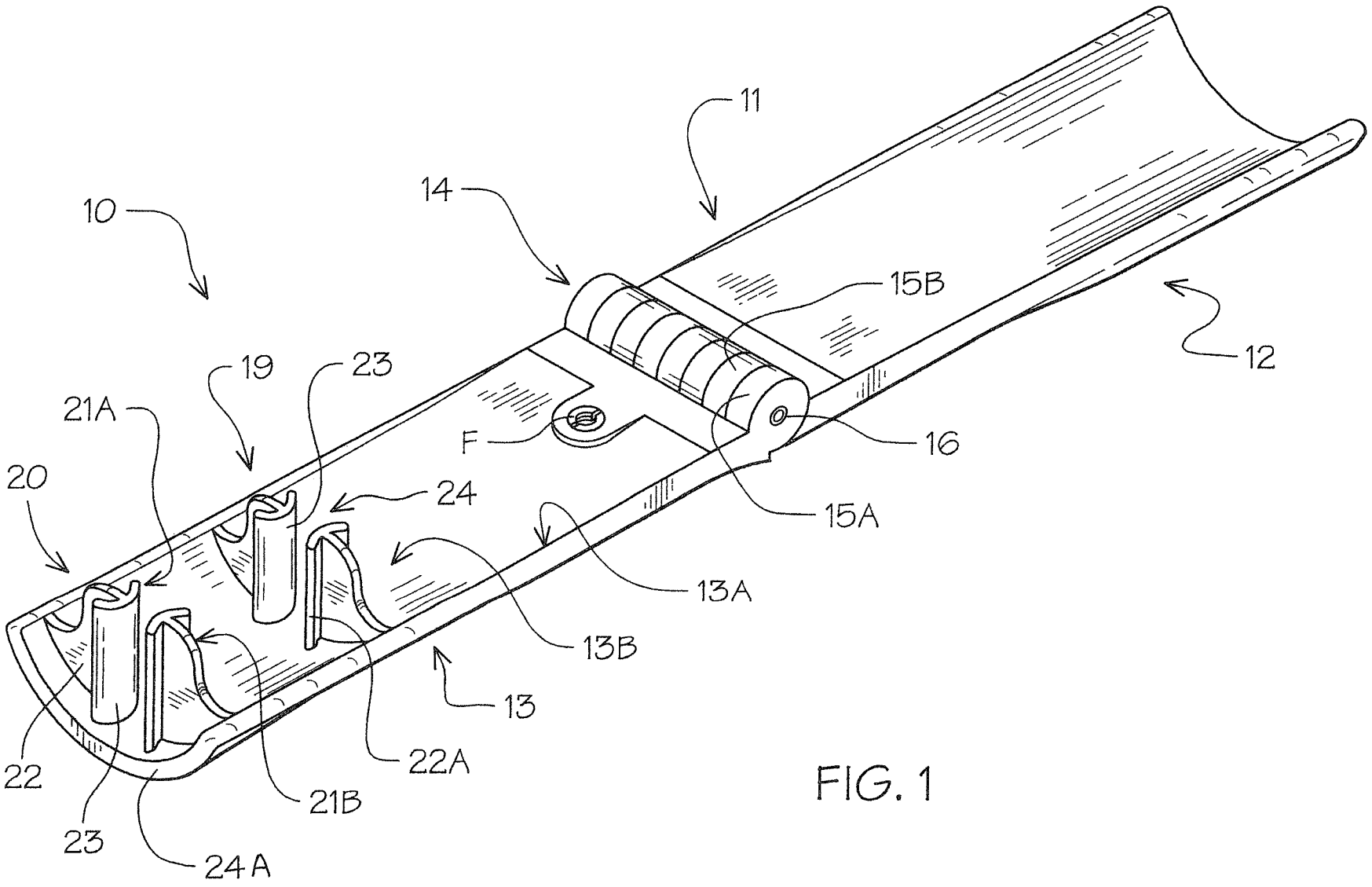
FIG. 1 is a perspective view of the percussion tuning tool in open use position.
Figure 2:
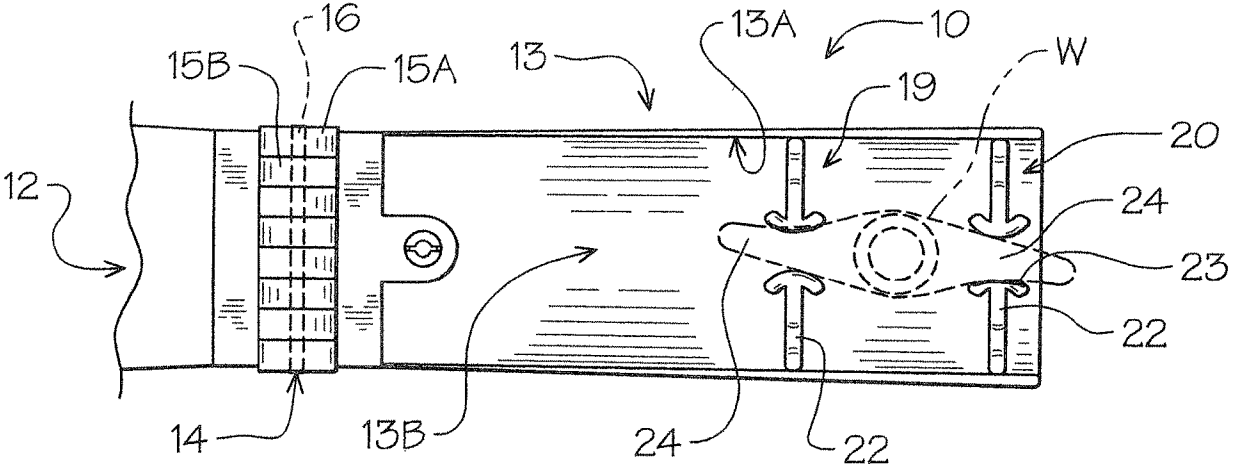
FIG. 2 is a partial top plan view in open use position, illustrating a tuning wingnut positioned there within broken lines.

Referring to FIGS. 1 and 2 of the drawings, a compact folding wingnut tool 10 of the invention can be seen having centrally hinged elongated housing 11 with a handle extension portion 12 and a wingnut engagement portion 13. The housing 11 is formed with an integrated hinge 14 defined from adjoining overlapping end portions of the respective handle and wingnut portions 12,13 respectively, as will be described in greater detail hereinafter.

The elongated housing 11 is transversely curved defining concave interior surfaces extending inwardly from their respective free ends and diminishing to the hinge 14, which is formed from multiple overlapping aligned tabs 15A, 15B extending from each of the respective housing portions and containing a center hinge pin 16 therethrough.

Figure 6:
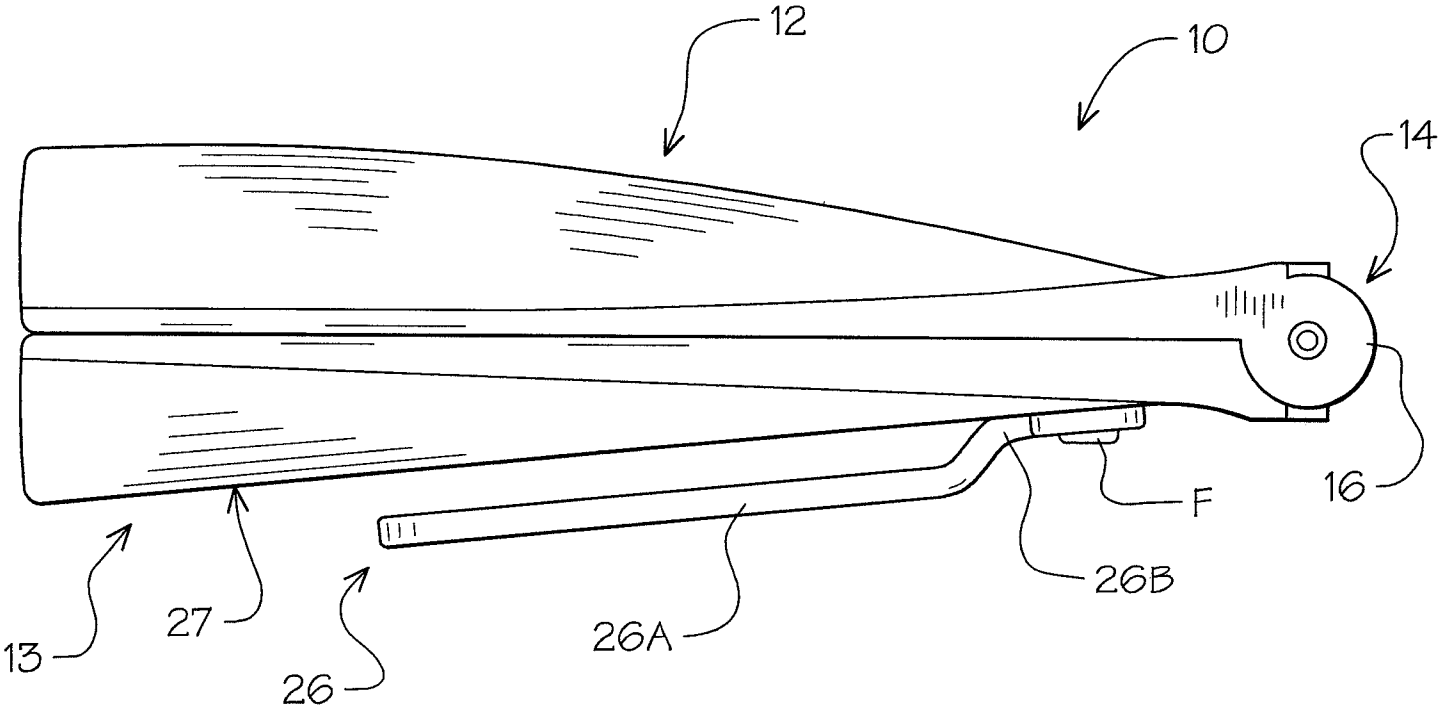
FIG. 6 is a side elevational view in closed transport storage position.

It will be evident from the above description that each of the respective housing portions are of the equal dimension so when brought together in a clamshell fashion as seen in FIG. 6 of the drawings they are registerably engaged to one another in a continuous contoured external exterior shape.

Figure 5:
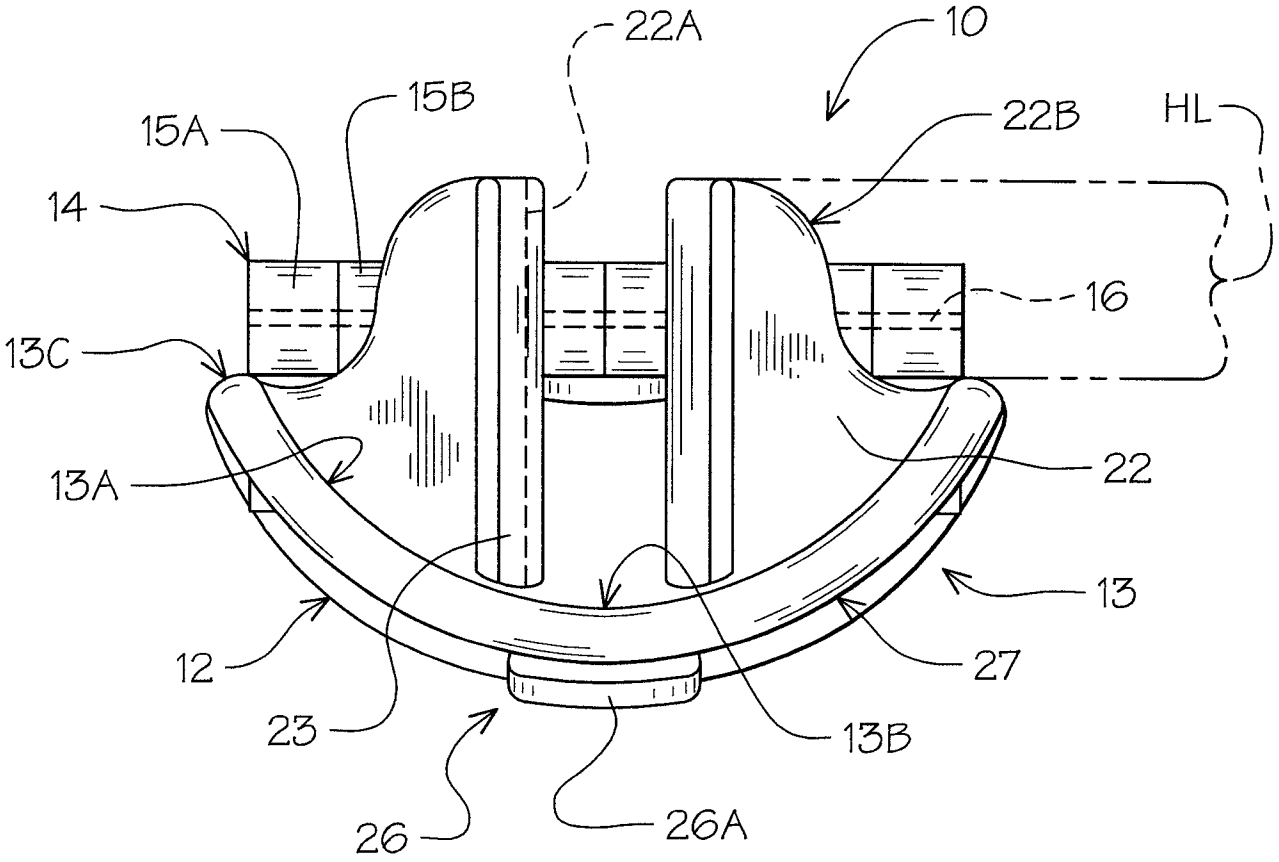
FIG. 5 is an enlarged end elevational view thereof on lines 5-5 of FIG. 4.

The wingnut engagement portion 13 has pairs of upstanding spaced aligned effacing wingnut engagement elements 19, 20 extending integrally from the corresponding interior side surfaces 13A, best seen in FIGS. 1, 2 and 5 of the drawings. Each of the engagement pairs 19, 20 are identical having a first and second identical effacing tab elements 21A, 21B. Each of the respective tab elements 21A, 21B are formed from an upstanding support tab portion 22 extending at right angles from the respective interior side edge surfaces 13A, as seen best in FIGS. 1 and 2 of the drawings.

Each of the tab portions 22 have an elongated curvilinear end extension portion 23 there across, extending the length of a tab end edge 22A and correspondingly outwardly in oppositely disposed equal relation therefrom to the bottom interior surface 13B of the wingnut engagement portion 13.

Each of the respective tab elements 21A, 21B are in aligned space relation to one another, defining a wingnut receiving gap at 24 therebetween, best seen in FIG. 2 of the drawings.

Referring now to FIG. 5 of the drawings, each of the respective tab portions 22 have a contoured upper free edge 22B that extends from an upper edge 13C of the interior side surface 13A to the corresponding top edge of the end extensions 23, which is of the greater height as indicated by height line HL.

Figure 7:
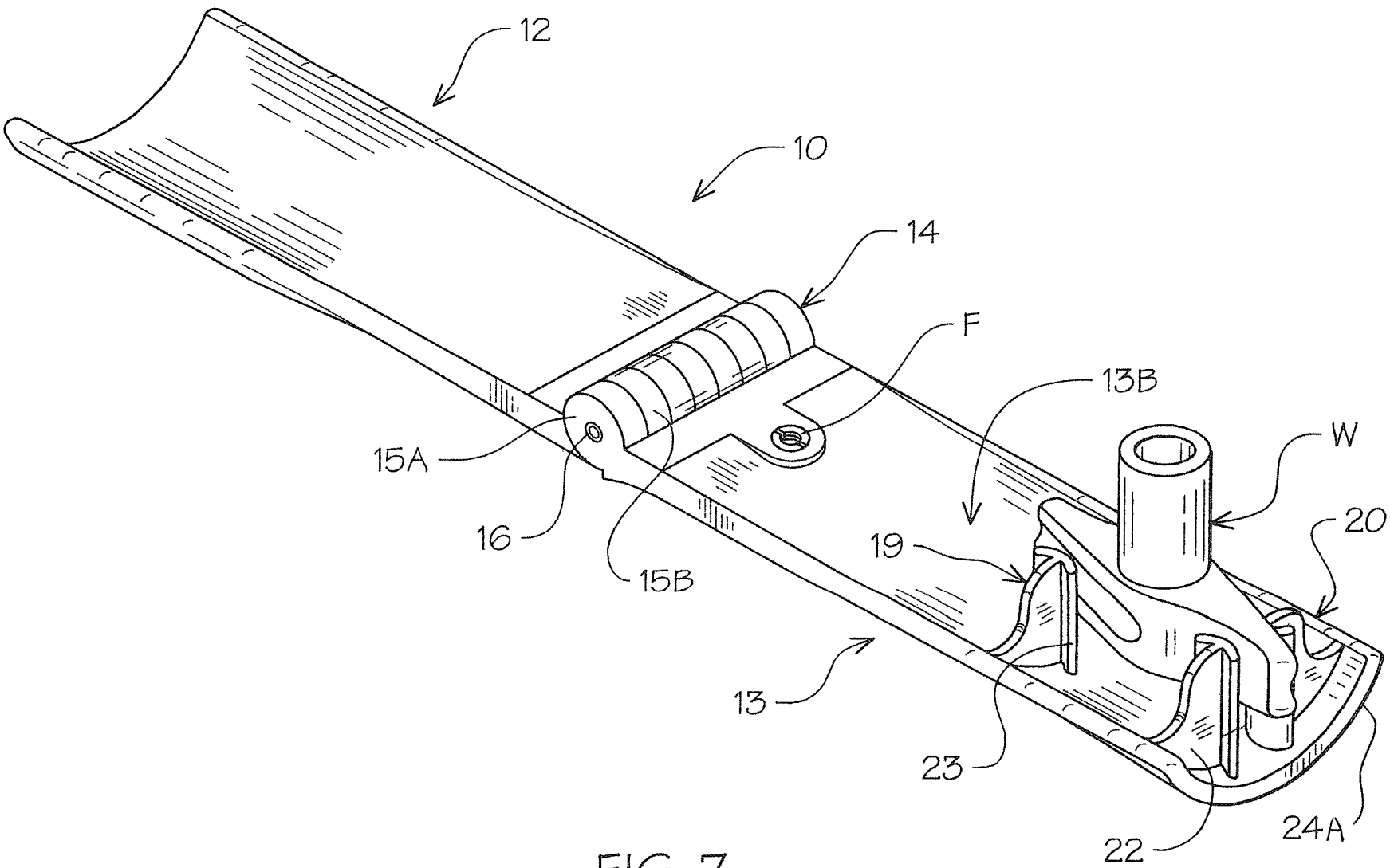
FIG. 7 is a perspective view of the tuning tool engaging a tuning wingnut.

It will therefore be seen that the effective wingnut receiving gaps at 24 between the respective tab elements 21A, 21B are of an increased depth to accommodate a variety of dimensional aspects of wingnuts W that one may encounter, providing a universality to practical use of the wingnut tool 10 of the invention and a variety of applications, as seen in broken lines in FIG. 2 and solid lines in FIG. 7 of the drawings.

The wingnut engagement element pairs 19, 20 as noted are positioned within the wingnut engagement portion 13 with the specific engagement element pair 20 positioned inwardly of a free end edge 24A of the wingnut engagement portion 13 wherein the effective longitudinal spacing between the respective identical aligned wingnut engagement pairs 19, 20 is proportional equal to approximately one-third of the overall length of the wingnut engagement portion 13 from its free end 24 to the center spaced hinge 14, as best seen in FIG. 1 of the drawings.

This orientation thereby defines the positioning of the respective wingnut engagement pairs 19, 20 at the corresponding end area of the wingnut portion 13, assuring the lever action advantage with the handle portion 12 extended for use, as noted hereinbefore.

Figure 3:
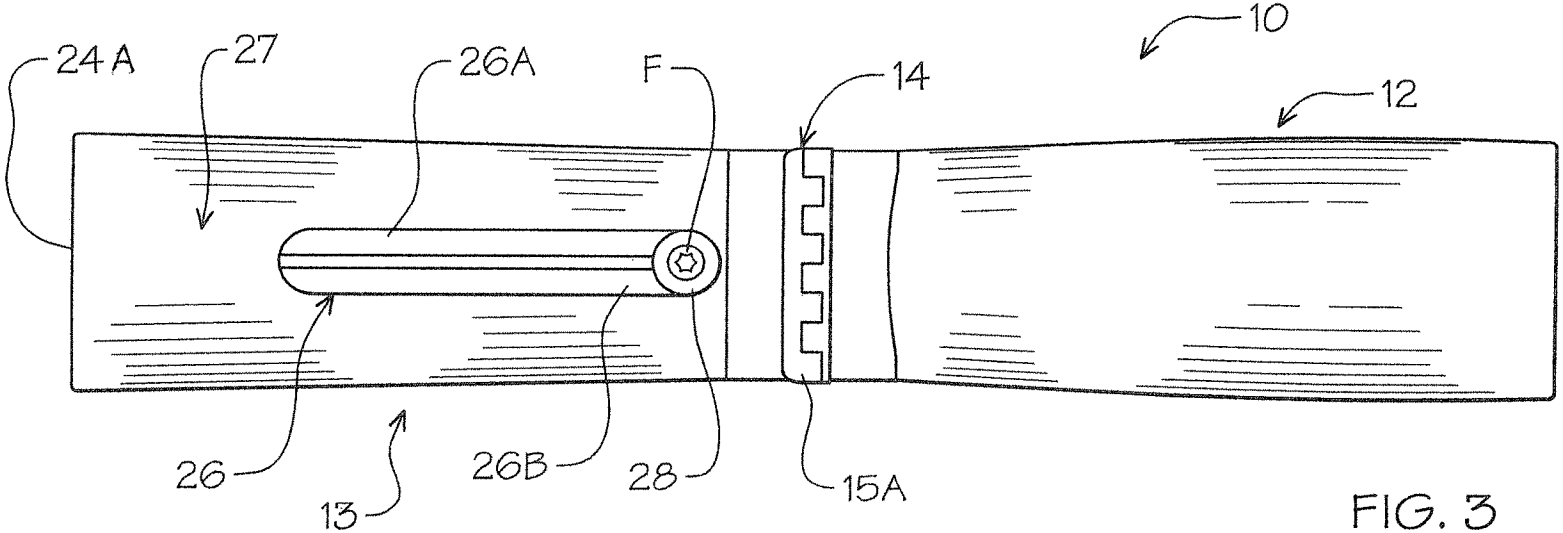
FIG. 3 is a bottom plan view in open use position.
Figure 4:
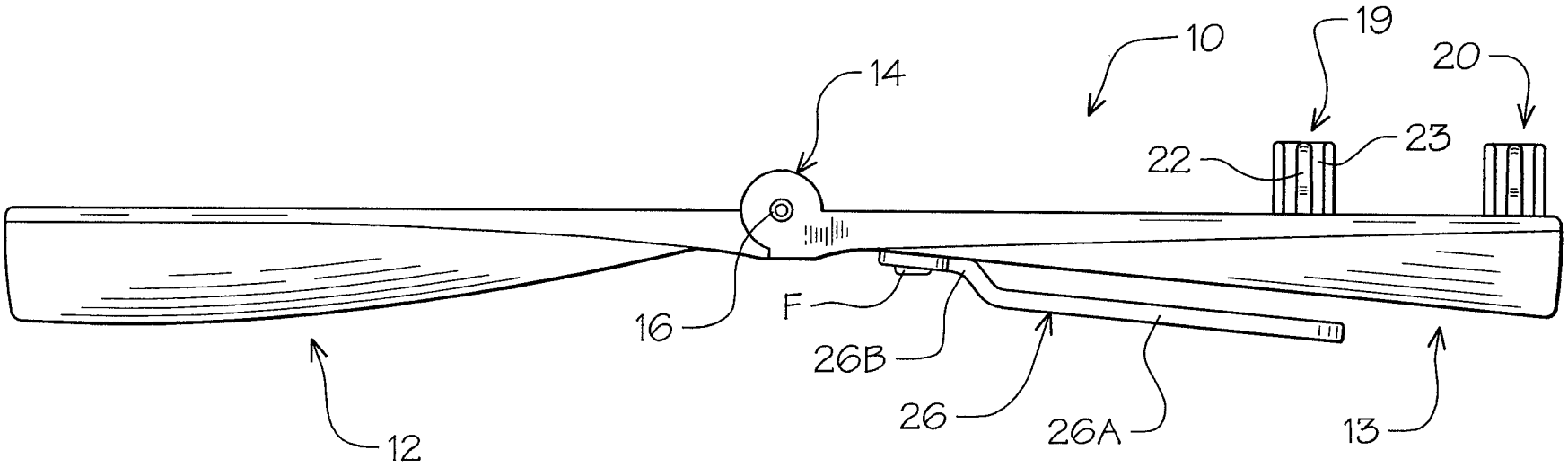
FIG. 4 is a side elevational view of the tuning tool in open position.

Referring now to FIGS. 3 and 4 of the drawings, a belt retainer clip 26 can be seen which is secured to the outer convex surface 27 of the wingnut engagement portion 13, having an elongated flat main body member 26A with an apertured offset attachment mounting portion 26B extending therefrom. A fastener F extends through the apertured offset attachment mounting portion 26B and through a corresponding aligned opening 28 in the wingnut engagement portion 13, adjacent to hinge 14 as seen in FIGS. 1 and 3 of the drawings. This provides for a convenient carrying mount for the wingnut tool 10 when in folded transport position, as shown in FIG. 4 of the drawings, as will be well understood by those skilled in the art.

The compact folding wingnut tool 10 of the invention is preferably made out of molded synthetic resin material with the hinge 14, as hereinbefore described formed by the integral extending apertured spaced tabs 15A, 15B on each of the respective body members 12, 13 which are engaging to one another and held in place as noted by a retainment hinge pin 15 there through.

It will thus be seen that a new and novel compact folding wingnut tool 10 has been illustrated and described, and will be apparent to those skilled in the art that various changes and modifications may be made thereto without departing from the spirit of the invention.

Therefore, I claim:

1. A folding wingnut tool comprising, an elongated contoured hinged body member having a handle portion and a wingnut engagement portion, and a center hinge there between, said handle portion and said wingnut engagement portion having concave interior and convex exterior surfaces, pairs of spaced upstanding aligned wingnut engagements within said wingnut engagement portion, each of said wingnut engagements pairs comprising, a first and second fixed identical spaced effacing nut engaging elements, said nut engaging elements having curved effacing end extensions surfaces on respective support tabs extending from corresponding side and bottom interior surfaces of said contoured wingnut engagement portion.

2. The folding wingnut tool set forth in claim 1 wherein said handle portion and said wingnut engagement portion are of an equal length and width.

3. The folding wingnut tool set forth in claim 1 wherein said spaced wingnut engagements are positioned inwardly from said wingnut engagement portions free end and in space relation to one another.

4. The folding wingnut tool set forth in claim 1 wherein said handle portion and said wingnut engagement portions concave interior and convex exterior surfaces extend inwardly from their respective free ends in transition to said central hinge.

5. The folding wingnut tool set forth in claim 4 wherein said wingnut engagement portion further comprises, an offset belt clip extending from said convex exterior surface, said belt clip having an elongated main body member and an angularly offset apertured integral end portion secured to said wingnut engagement portion adjacent said hinge.

6. The folding wingnut tool set forth in claim 1 wherein said pairs of upstanding wingnut engagements extend beyond upper edge surfaces of side surfaces of said wingnut engagement portion.

7. The folding wingnut tool set forth in claim 1 wherein said center hinge comprises, a plurality of aligned spaced interlinking apertured tab extensions on said respective handle portion and said wingnut engagement portion.

8. The folding wingnut tool set forth in claim 1 wherein said wingnut engagement pairs are in spaced longitudinal alignment defining an elongated wingnut engagement gap between said wingnut engagement pairs and respective engagements within each of said effacing nut engagement elements of said wingnut engagement pairs.

* * * * *